US010858958B2

(12) United States Patent
Quennehen et al.

(10) Patent No.: US 10,858,958 B2
(45) Date of Patent: Dec. 8, 2020

(54) TURBINE RING ASSEMBLY HELD BY JAW COUPLING

(71) Applicants: SAFRAN AIRCRAFT ENGINES, Paris (FR); SAFRAN CERAMICS, Le Haillan (FR)

(72) Inventors: Lucien Henri Jacques Quennehen, Paris (FR); Sebastien Serge Francis Congratel, La Brosse Montceaux (FR)

(73) Assignees: SAFRAN AIRCRAFT ENGINES, Paris (FR); SAFRAN CERAMICS, Le Haillan (FR)

( * ) Notice: Subject to any disclaimer, the term of this patent is extended or adjusted under 35 U.S.C. 154(b) by 326 days.

(21) Appl. No.: 15/575,137

(22) PCT Filed: May 18, 2016

(86) PCT No.: PCT/FR2016/051167

§ 371 (c)(1),
(2) Date: Nov. 17, 2017

(87) PCT Pub. No.: WO2016/189222

PCT Pub. Date: Dec. 1, 2016

(65) Prior Publication Data

US 2018/0142572 A1 May 24, 2018

(30) Foreign Application Priority Data

May 22, 2015 (FR) ..... 15 54605

(51) Int. Cl.
*F01D 25/24* (2006.01)
*F01D 11/08* (2006.01)

(52) U.S. Cl.
CPC ..... *F01D 25/246* (2013.01); *F01D 11/08* (2013.01); *F05D 2240/11* (2013.01); *F05D 2300/6033* (2013.01)

(58) Field of Classification Search
CPC ..... F01D 25/246
See application file for complete search history.

(56) References Cited

U.S. PATENT DOCUMENTS 4,087,199 A 5/1978 Hemsworth et al.
5,632,600 A * 5/1997 Hull ..... F01D 5/06 416/198 A (Continued)

FOREIGN PATENT DOCUMENTS

EP 2 631 434 A2 8/2013
GB 2485016 A 5/2012

OTHER PUBLICATIONS

International Search Report dated Jul. 29. 2016, in PCT/FR2016/051167 filed May 18, 2016.

*Primary Examiner* — Nathaniel E Wiehe
*Assistant Examiner* — John S Hunter, Jr.
(74) *Attorney, Agent, or Firm* — Oblon, McClelland, Maier & Neustadt, L.L.P.

(57) ABSTRACT

A turbine ring assembly includes a plurality of ring sectors of ceramic matrix composite material forming a turbine ring and a ring support structure secured to a turbine casing and having two annular flanges, each ring sector having two tabs held between the two annular flanges. The ring support structure includes an annular retention band mounted on the turbine casing, the annular retention band including an annular web forming one of the flanges. The two annular flanges exert stress on the tabs of the ring sectors. One of the flanges is elastically deformable in the axial direction of the turbine ring. The band has a first series of teeth distributed circumferentially on the band and the turbine casing has a second series of teeth distributed circumferentially on the casing, and the teeth of the first series and the teeth of the second series together provide circumferential jaw coupling.

8 Claims, 6 Drawing Sheets

(56) References Cited

U.S. PATENT DOCUMENTS

| | | | | |
|---|---|---|---|---|
| 6,575,697 | B1 * | 6/2003 | Arilla | F01D 11/005 415/173.1 |
| 2012/0107122 | A1 | 5/2012 | Albers et al. | |

* cited by examiner

TURBINE RING ASSEMBLY HELD BY JAW COUPLING

BACKGROUND OF THE INVENTION

The invention relates to a turbine ring assembly for a turbine engine, which assembly comprises a plurality of ring sectors, each made as a single piece of ceramic matrix composite material, together with a ring support structure.

The field of application of the invention is specifically that of gas turbine aeroengines. The invention is nevertheless applicable to other turbine engines, e.g. industrial turbines.

Ceramic matrix composite (CMC) materials are known for their good mechanical properties that make them suitable for constituting structural elements, and for their ability to conserve those properties at high temperatures.

In gas turbine aeroengines, improving efficiency and reducing polluting emissions leads to striving for ever higher operating temperatures. For turbine ring assemblies that are made entirely out of metal, it is necessary to cool all of the elements of the assembly, and in particular the turbine ring, since it is subjected to high-temperature streams. Such cooling has a significant impact on the performance of the engine, since the cooling stream used is taken from the main gas stream passing through the engine. Furthermore, the use of metal for the turbine ring puts a limit on potential for increasing temperature in the turbine, even though that would improve the performance of aeroengines.

The use of CMC for various hot parts of such engines has already been envisaged, in particular since CMCs present density that is less than that of the refractory metals conventionally used.

Thus, making turbine ring sectors as single pieces of CMC is described in particular in Document US 2012/0027572. The ring sectors have an annular base with an inner face defining the inside face of the turbine ring and an outer face from which there extend two tab-forming portions with ends that are engaged in housings of a metal ring support structure.

The use of CMC ring sectors makes it possible to reduce significantly the ventilation requirements for cooling the turbine ring. Nevertheless, sealing between the gas flow passage on the inside of the ring sectors and the outside of the ring sectors remains a problem. Specifically, in order to provide good sealing, it is necessary to be able to ensure good contact between the tabs of the CMC ring sectors and metal flanges of the ring support structure. Unfortunately, differential expansion between the metal of the ring support structure and the CMC of the ring sectors complicates maintaining sealing between those elements. Thus, during differential expansion, and depending on the geometry for mounting the ring sectors on the ring support structure, the flanges of the ring support structure may cease to be in contact with the tabs of the sectors, or on the contrary may exert excessive stress on the tabs of the sectors, which might damage them.

In addition, as described in Document US 2012/0027572, holding ring sectors on the ring support structure requires the use of a clamp of U-section, which makes it more complicated to mount the sectors and increases the cost of the assembly.

OBJECT AND SUMMARY OF THE INVENTION

The invention seeks to avoid such drawbacks and for this purpose it proposes a turbine ring assembly comprising a plurality of ring sectors of ceramic matrix composite material forming a turbine ring and a ring support structure secured to a turbine casing and having two annular flanges, each ring sector having a portion forming an annular base with an inner face defining the inside face of the turbine ring and an outer face from which two tabs extend radially, the tabs of each ring sector being held between the two annular flanges of the ring support structure, the ring support structure including an annular retention band mounted on the turbine casing, the annular retention band including an annular web forming one of the flanges of the ring support structure, the two annular flanges of the ring support structure exerting stress on the tabs of the ring sectors, at least one of the flanges of the ring support structure being elastically deformable in the axial direction of the turbine ring, the turbine ring assembly being characterized in that the band has a first series of teeth distributed circumferentially on said band and the turbine casing has a second series of teeth distributed circumferentially on said casing, the teeth of the first series of teeth and the teeth of the second series of teeth together providing circumferential law coupling.

This connection by jaw coupling enables ring sectors to be mounted and removed easily.

In addition, because of the presence of at least one elastically deformable flange, contact between the flanges of the ring support structure and the tabs of the ring sectors can be maintained independently of variations in temperature. Specifically, the ring sectors may be mounted between the flanges with prestress while "cold", such that contact between the ring sectors and the flanges is ensured regardless of temperature conditions. The flexibility of at least one of the flanges of the ring support structure makes it possible by deforming to accommodate differential thermal expansion between the ring sectors and the flanges so as to avoid exerting excessive stress against the ring sectors.

In first aspect of the turbine ring assembly of the invention, the turbine casing has an annular projection extending between a shroud of the casing and the band of the ring structure. This prevents upstream-to-downstream leaks between the casing and the band.

In a second aspect of the turbine ring assembly of the invention, at least one of the annular flanges of the ring support structure includes a lip on its face facing the tabs of the ring sectors. The presence of a lip on a flange facilitates defining the contact portion between the flange of the ring support structure and the tabs of the ring sectors facing it.

In a third aspect of the turbine ring assembly of the invention, it further comprises a first plurality of pegs each engaged both in one of the annular flanges of the ring support structure and also in a tab of the ring sectors facing said annular flange, and a second plurality of pegs each engaged both in the other annular flange of the ring support structure and also in a tab of the ring sectors facing said other annular flange. The pegs serve to prevent any turning of the ring sectors within the ring support structure and to keep them radially in position in said structure.

In a fourth aspect of the turbine ring assembly of the invention, each elastically deformable flange of the ring support structure presents thickness that is less than the thickness of the other flange of said ring support structure.

The present invention also provides a method of making a turbine ring assembly, the method comprising:

fabricating a plurality of ring sectors out of ceramic matrix composite material, each ring sector having a portion forming an annular base with an inner face defining the inside face of a turbine ring, and an outer face from which first and second tabs extend radially;

fabricating a ring support structure having a first annular flange secured to a turbine casing and an annular retention band including a second annular flange, said band being for assembling with the turbine casing;

mounting each first tab of the ring sectors on the first annular flange of the ring support structure;

mounting the annular retention band on the turbine casing by jaw coupling, the second flange being held pressed against each second tab, said annular retention band being mounted with axial prestress on the turbine casing, at least one of the flanges of the ring support structure being elastically deformable in the axial direction of the turbine ring.

By mounting the band by jaw coupling, it is possible to position the tabs of the ring sectors between the flanges of the ring support structure without any need to force said tabs, which are subsequently held with stress between the flanges after the band has been mounted.

In a first aspect of the method of the invention for making a turbine ring assembly, the turbine casing includes an annular projection extending between a shroud of said casing and the band of the ring structure.

In a second aspect of the method of the invention for making a turbine ring assembly, at least one of the annular flanges of the ring support structure includes a lip on its face facing the tabs of the ring sectors.

In a third aspect of the method of the invention for making a turbine ring assembly, the assembly further comprises engaging each peg of a first plurality of pegs both in the first annular flange of the ring support structure and also in a first tab of the ring sectors while mounting said first tabs, and after the annular retention band has been mounted by jaw coupling, engaging each peg of a second plurality of peas both in the second annular flange and also in a second tab of the ring sectors.

In a fourth aspect of the method of the invention for making a turbine ring assembly, the elastically deformable flange of the ring support structure presents thickness that is less than the thickness of the other flange of said ring support structure.

BRIEF DESCRIPTION OF THE DRAWINGS

The invention can be better understood on reading the following description given by way of non-limiting indication and with reference to the accompanying drawings, in which.

DETAILED DESCRIPTION OF EMBODIMENTS

Figure 1:
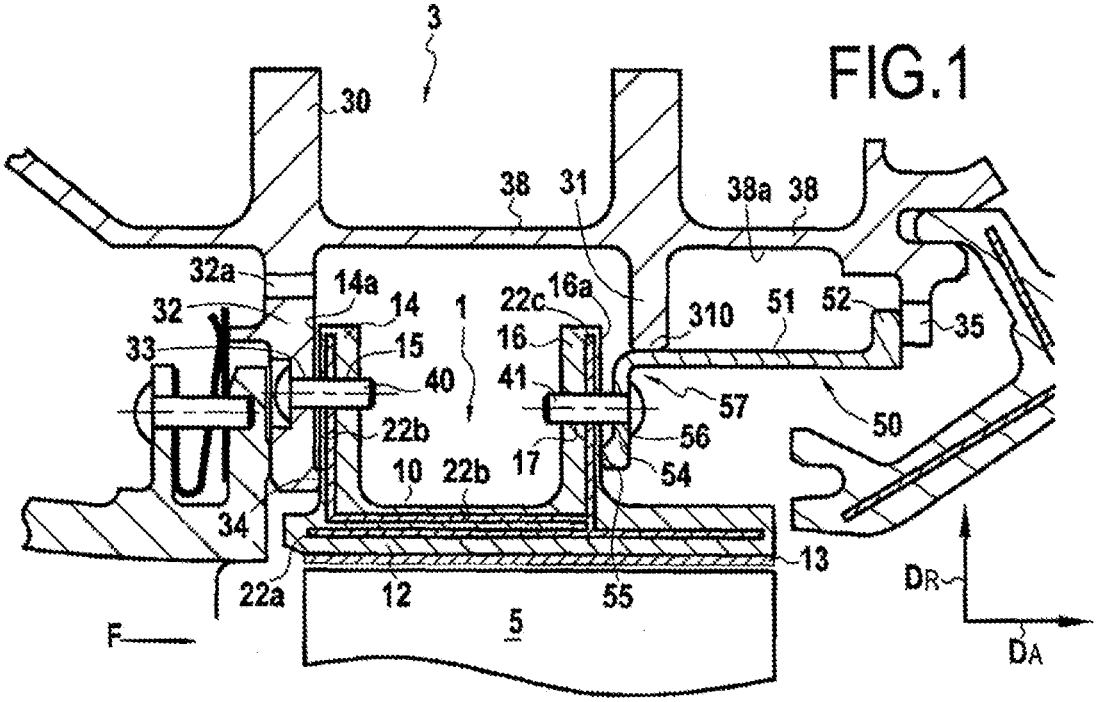
FIG. 1 is a radial half-section view showing an embodiment of a turbine ring assembly of the invention.

FIG. 1 shows a high pressure turbine assembly comprising a turbine ring 1 made of ceramic matrix composite (CMC) material and a metal ring support structure 3. The turbine ring 1 surrounds a set of rotary blades S. The turbine ring 1 is made up of a plurality of ring sectors 10, FIG. 1 being a radial section view on a plane passing between two contiguous ring sectors. Arrow $D_A$ gives the axial direction relative to the turbine ring 1, while arrow $D_R$ gives the radial direction relative to the turbine ring 1.

Each ring sector 10 has a section that is substantially in the shape of an upside-down letter π, with an annular base 12 having its inner face coated in a layer 13 of abradable material and/or a thermal barrier for defining the flow passage for the gas stream through the turbine. Upstream and downstream tabs 14 and 16 extend from the outer face of the annular base 12 in the radial direction $D_R$. The terms "upstream" and "downstream" are used herein relative to the flow direction of the gas stream through the turbine (arrow F).

Figure 4:
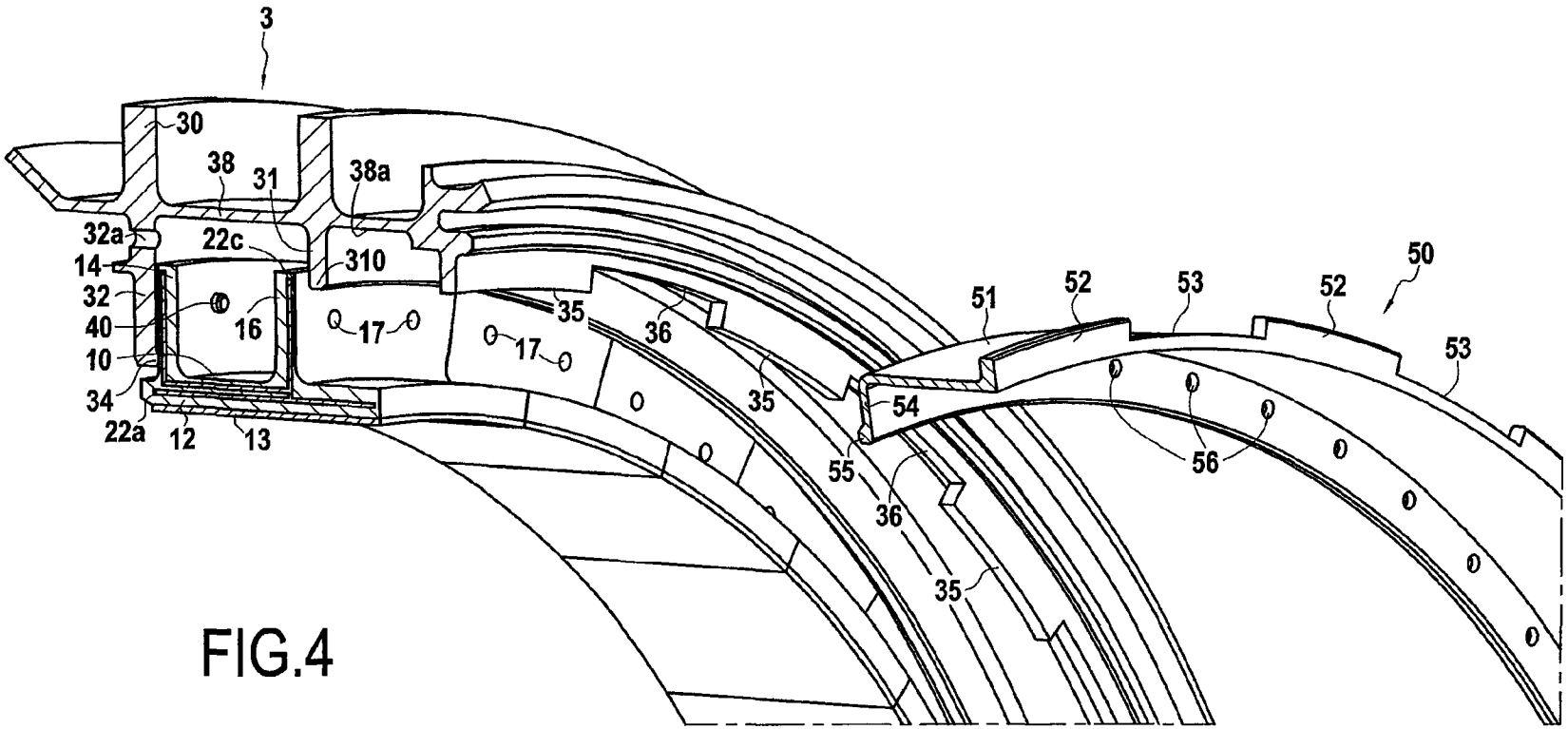
Figure 7A:
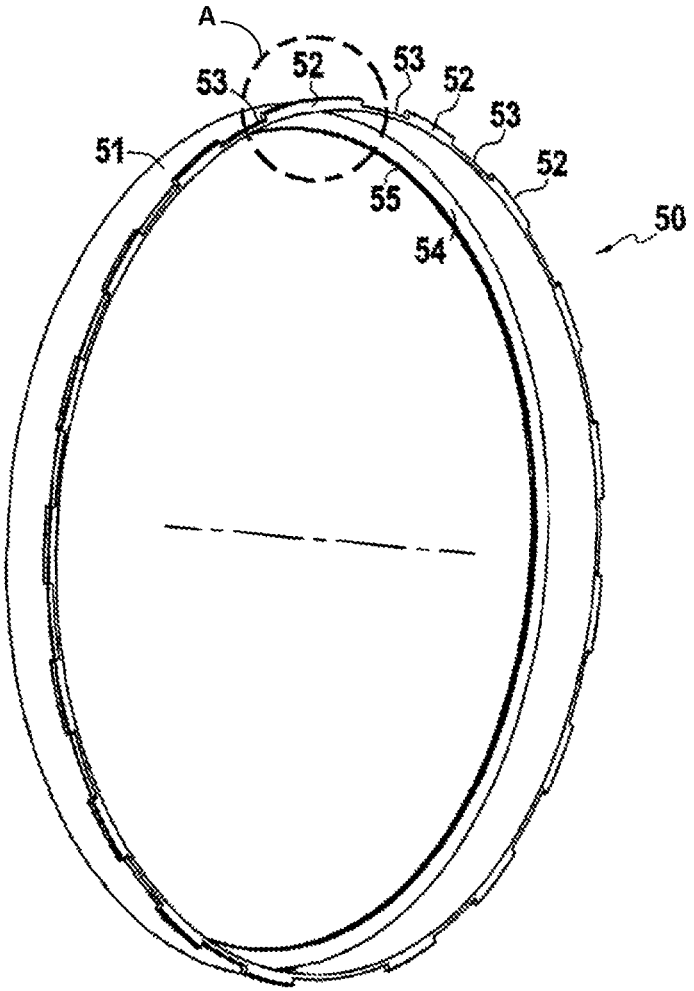
FIG. 7*a* is a diagrammatic perspective view of the band of FIGS. 1, 3, 4, and 5.
Figure 7B:
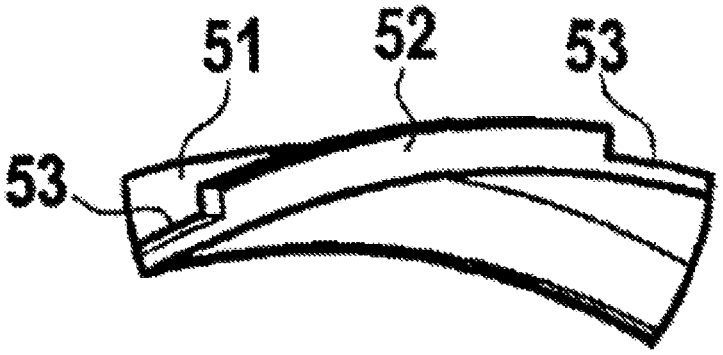
FIG. 7*b* is an enlarged perspective view of the area A shown in FIG. 7*a*.

The ring support structure 3 is made up of two portions, namely a first portion corresponding to an annular upstream radial flange 32, which is preferably formed integrally with a turbine casing 30, and a second portion corresponding to an annular retention band 50 mounted on the turbine casing 30. The annular upstream radial flange 32 has a lip 34 on its face facing the upstream tab 14 of the ring sectors 10, the lip 34 bearing against the outer faces 14*a* of the upstream tabs 14. On the downstream side, the band 50 has an annular web 57 that forms an annular downstream radial flange 54 having a lip 55 on its face facing the downstream tabs 16 of the ring sectors 10, the lip 55 bearing against the outer faces 16*a* of the downstream tabs 16. The band 50 has an annular body 51 that extends axially and that comprises, at its upstream end, the annular web 57, and at its downstream end, a first series of teeth 52 that are circumferentially distributed around the band 50 and spaced apart from one another by first engagement passages 53 (FIGS. 4, 7*a*, and 7*b*). The turbine casing 30 includes at its downstream end a second series of teeth 35 extending radially from the inner surface of the shroud 38 of the turbine casing 30. The teeth 35 are distributed circumferentially around the inner surface 38*a* of the shroud 38 and they are spaced apart from one another by second engagement passages 36 (FIG. 4). The teeth 52 and 35 co-operate with one another to provide circumferential jaw coupling.

As explained below in detail, the tabs 14 and 16 of each ring sector 10 are mounted with prestress between the annular flanges 32 and 54 so that the flanges exert stress on the tabs 14 and 16, at least when "cold", i.e. at an ambient temperature of about 20°, and also at all operating temperatures of the turbine, thereby clamping the sectors by means of the flanges. This stress is maintained at all temperatures to which the ring assembly is to be subjected during operation of the turbine and it is under control, i.e. without any excess stress on the ring sectors, as a result of the presence of at least one flange that is elastically deformable, as explained-above below.

Furthermore, in the presently-described example, the ring sectors 10 are also held by blocking pegs. More precisely, and as shown in FIG. 1, pegs 40 are engaged both in the annular upstream radial flange 32 of the ring support structure 3 and also in the upstream tabs 14 of the ring sectors 10. For this purpose, each peg 40 passes respectively through an orifice 33 formed in the annular upstream radial flange 32 and an orifice 15 formed in each upstream tab 14, the orifices 33 and 15 being put in alignment when mounting the ring sectors 10 on the ring support structure 3. Likewise, pegs 41 are engaged both in the annular downstream radial flange 54 of the band 50 and also in the downstream tabs 16 of the ring sectors 10. For this purpose, each peg 41 passes respectively through an orifice 56 formed in the annular downstream radial flange 54 and an orifice 17 formed in each downstream tab 16, the orifices 56 and 17 being put into alignment when mounting the ring sectors 10 on the ring support structure 3. In a variant embodiment, it is possible to use pegs of a length that is greater than or equal to the distance between the two flanges. Under such circumstances, each peg passes through the orifices present in both flanges of the ring structure and in both tabs of the ring sectors.

In addition, sealing between sectors is provided by sealing tongues received in grooves that face one another in the facing edges of two neighboring ring sectors. A tongue 22*a* extends over nearly the entire length of the annular base 12 in the middle portion thereof. Another tongue 22*b* extends along the tab 14 and over a portion of the annular base 12. Another tongue 22*c* extends along the tab 16. At one end, the tongue 22*c* comes into abutment against the tongue 22*a* and against the tongue 22*b*. By way of example, the tongues 22*a*, 22*b*, and 22*c* may be made of metal, and they are mounted with clearance when cold in their housings in order to ensure the sealing function at the temperatures that are encountered in service.

Clearance-free assembly of the tabs 14, 16 of a CMC ring sector with the metal portions of the ring support structure is made possible in spite of the difference in coefficients of thermal expansion because:

- assembly is performed at a distance from the hot face of the annular base 12 that is exposed to the gas stream;
- the tabs 14, 16 advantageously present a relatively great length in radial section compared with their mean thickness, such that effective thermal decoupling is obtained between the annular base 12 and the ends of the tabs 14 and 16; and
- one of the flanges of the ring structure is elastically deformable, thus making it possible to compensate for differential expansion between the tabs of the CMC ring sectors and the flanges of the metal ring support structure without significantly increasing the stress that is exerted when "cold" by the flanges on the tabs of the ring sectors.

In conventional manner, ventilation orifices 32*a* formed in the flange 32 serve to bring in cooling air towards the outside of the turbine ring 10.

In addition, sealing from upstream to downstream of the turbine ring assembly is provided by an annular projection 31 extending radially from the inner surface 38*a* of the shroud 38 of the turbine casing 3 and having its free end 310 in contact with the surface of the body 51 of the band 50.

The method of making a turbine ring assembly corresponding to that shown in FIG. 1 is described below.

Each above-described ring sector 10 is made of ceramic matrix composite (CMC) material by forming a fiber preform of shape close to that of the ring sector and by densifying the ring sector with a ceramic matrix.

In order to make the fiber preform, it is possible to use yarns made of ceramic fibers, e.g. SIC fiber yarns such as those sold by the Japanese supplier Nippon Carbon under the name "Nicalon", or else carbon fiber yarns.

The fiber preform is advantageously made by three-dimensional weaving, or multilayer weaving with zones of non-interlinking being provided to make it possible to fold out the portions of the preform that correspond to the tabs 14 and 16 of the sectors 10.

The weaving may be of the interlock type, as shown. Other three-dimensional or multilayer weaves may be used, such as for example multi-plain or multi-satin weaves. Reference may be made to Document WO 2006/136755.

After weaving, the blank may be shaped in order to obtain a ring sector preform that is to be consolidated and densified with a ceramic matrix, which densification may be performed in particular by chemical vapor infiltration (CVI) or by metal infiltration (MI) with liquid silicon being inserted into the fiber preform by capillarity, the preform already being consolidated by a stage of CVI, which methods are themselves well known.

A detailed example of fabricating ring sectors out of CMC is described in particular in Document US 2012/0027572.

Figure 2:
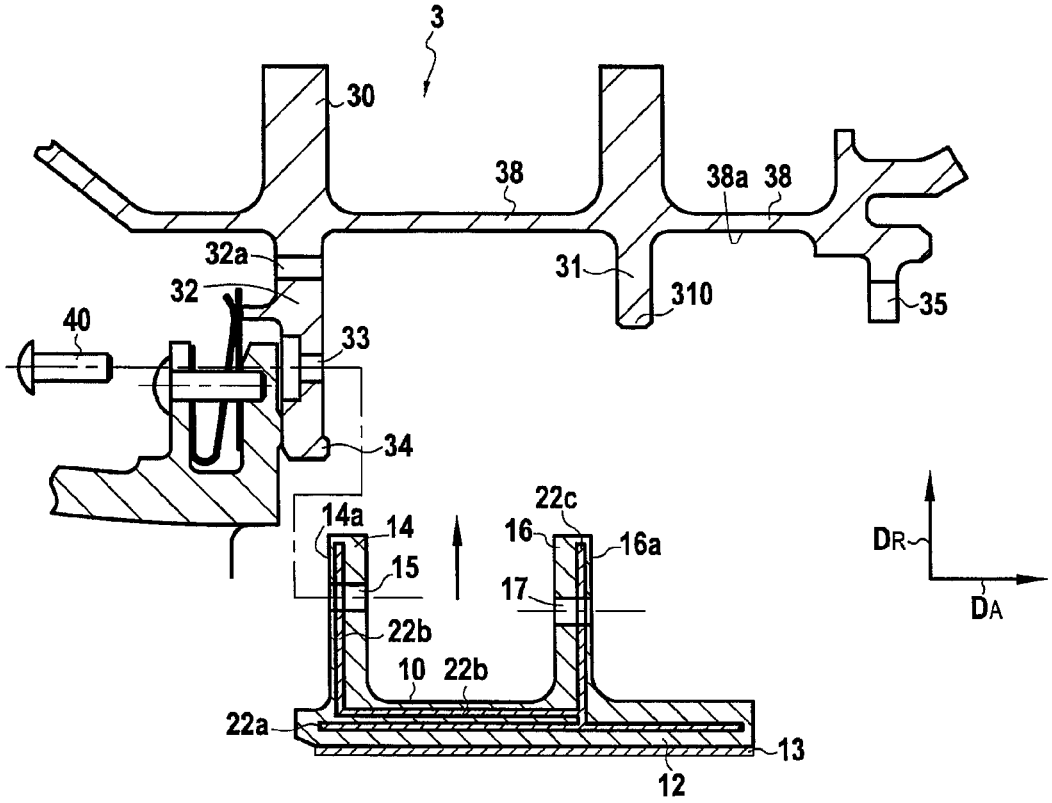
FIGS. 2 to 6 are diagrams showing how a ring sector is mounted in the ring support structure of the FIG. 1 ring assembly.
Figure 3:
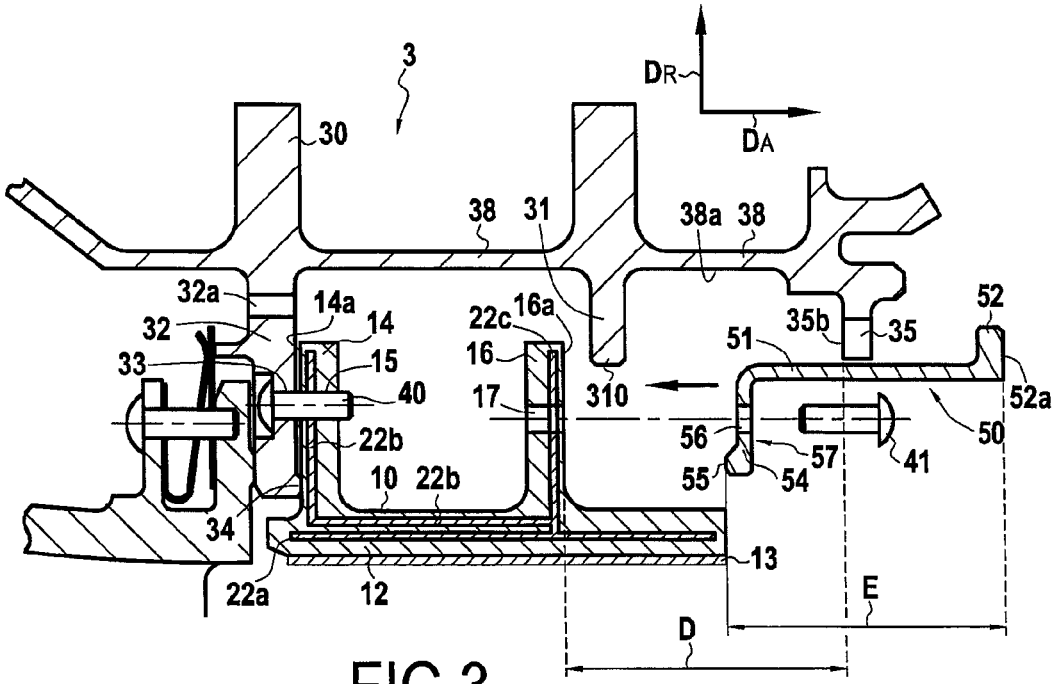

The ring support structure 3 is made out of a metal material such as Inconel®, the superalloy C263, or Waspaloy®. The making of the turbine ring assembly then continues by mounting the ring sectors 10 on the ring support structure 3. As shown in FIGS. 2 and 4, the ring sectors 10 are initially fastened via the upstream tabs 14 to the annular upstream radial flange 32 of the ring support structure 3 by pegs 40 that are engaged in the aligned orifices 33 and 15 formed respectively in the annular upstream radial flange 32 and in the upstream tabs 14.

Once all of the ring sectors 10 have been fastened in this way to the annular upstream radial flange 32, then the annular retention band 50 is assembled by jaw coupling between the turbine casing 3 and the downstream tabs of the ring sectors 10. In accordance with the presently-described embodiment, the spacing E between the annular upstream radial flange 54 formed b the annular web 57 of the band 50 and the outer surfaces 52*a* of the teeth 52 of said band is less than the distance D present between the outer faces 16*a* of the downstream tabs 16 of the ring sectors and the inner faces 35*b* of the teeth 35 present on the turbine casing 30. In the presently-described example, the spacing B is measured between the lip 55 present at the end of the annular flange 54 and the outer surfaces 52*a* of the teeth 52. In embodiments of the turbine ring assembly of the invention in which the annular flange(s) is/are without lips, the spacing is measured between the inner face of the flange present on the band that is in contact with the outer surfaces of the downstream tabs of the ring sectors and the outer surfaces of the teeth of the band.

By defining a spacing E between the annular upstream radial flange and the outer surfaces of the teeth of the band that is less than the distance D between the outer faces of the downstream tabs of the ring sectors and the inner faces of the teeth present on the turbine casing, it is possible to mount the ring sectors with prestress between the flanges of the ring support structure Nevertheless, in order to avoid damaging the tabs of the CMC ring sectors during mounting, and in accordance with the invention, the ring support structure has at least one annular flange that is elastically deformable in the axial direction $D_A$ of the ring. In the presently-described example, it is the annular downstream radial flange 54 present on the band 50 that is elastically deformable. Specifically, the annular web 57 forming the annular downstream radial flange 54 of the ring support structure 3 presents small thickness, e.g., a thickness of less than 2.5 millimeters (mm), thereby giving it a certain amount of resilience.

Figure 5:
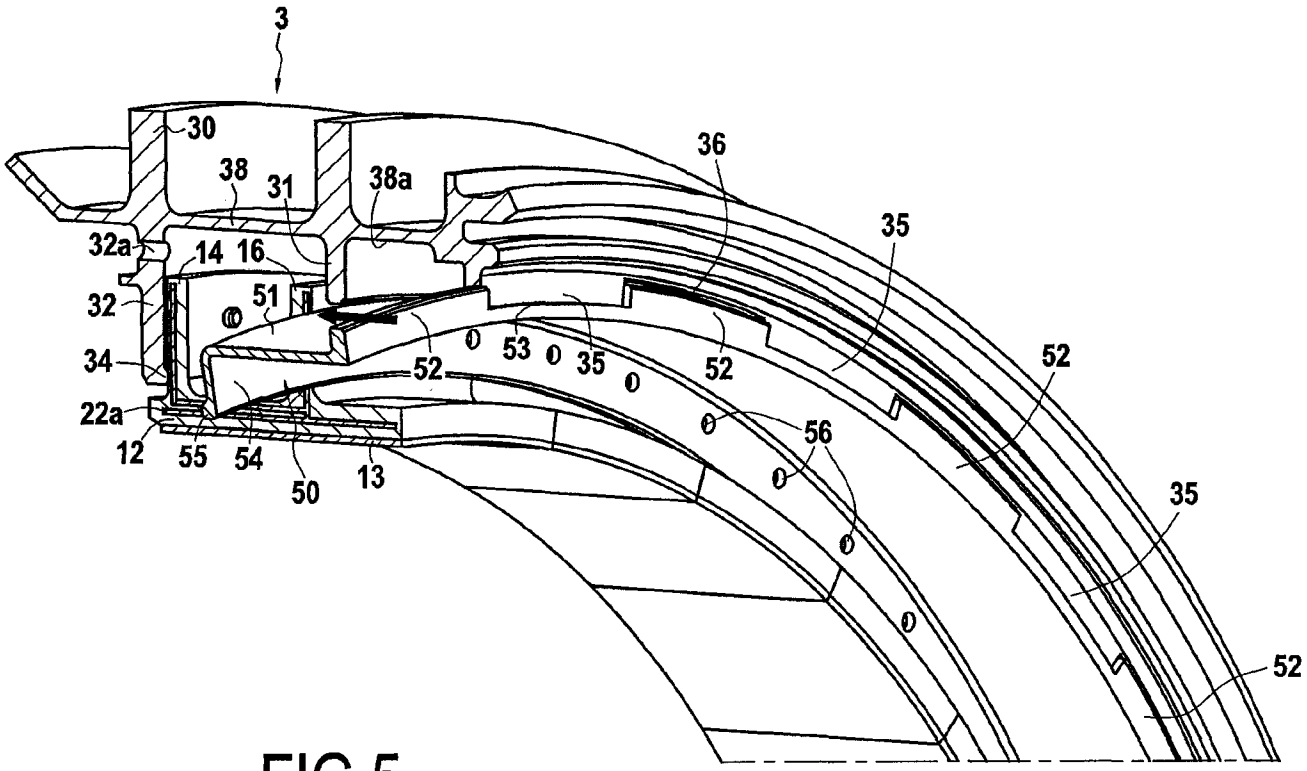
Figure 6:
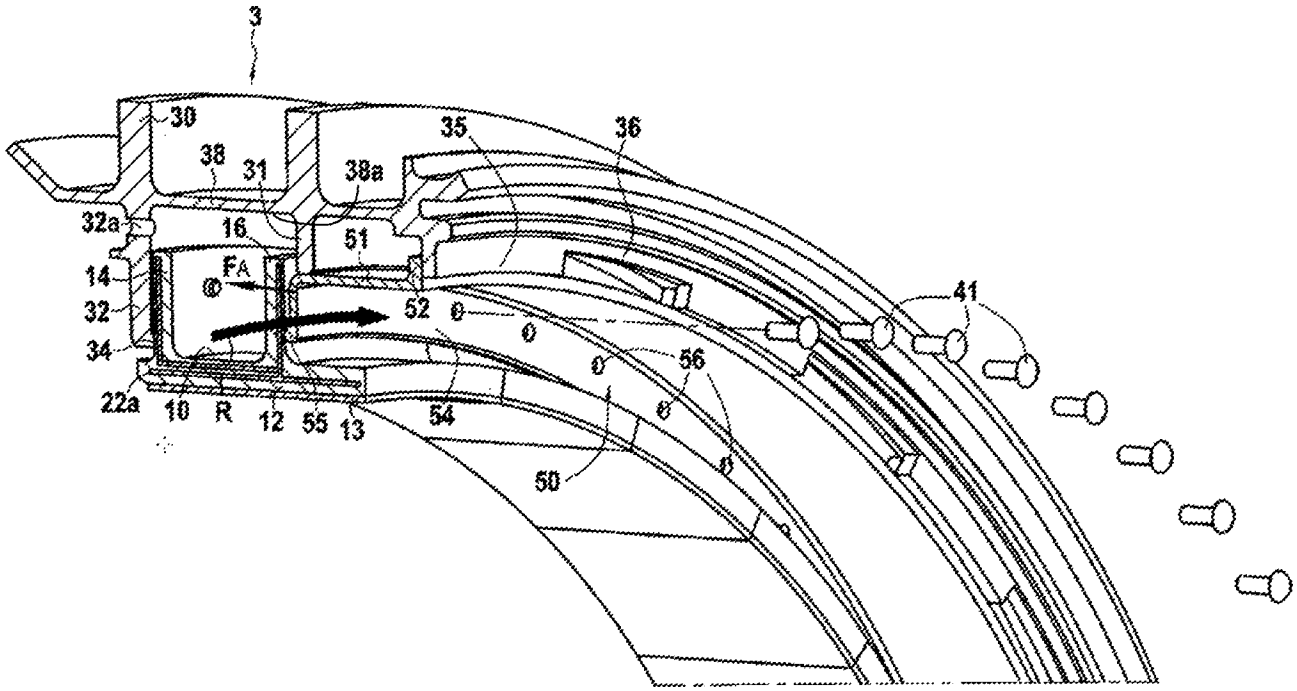

As shown in FIGS. 5 and 6, the band 50 is mounted on the turbine casing 30 by placing the teeth 52 present on the band 50 so that they face the engagement passages 36 formed on the turbine casing 30, with the teeth 35 present on said turbine casing then likewise being placed facing the engagement passages 53 formed between the teeth 52 on the band 50. Since the spacing E is less than the distance D, it is necessary to apply an axial force FA on the band 50 in the direction shown in FIG. 6 in order to engage the teeth 52 beyond the teeth 35 and allow the band to perform a movement in rotation R through an angle corresponding substantially to the width of the teeth 35 and 52. After this movement in rotation, the band 50 is released, then being held in axial stress between the upstream tabs 16 of the ring sectors 10 and the inner surfaces 35*b* of the teeth 35 of the turbine casing 30.

Once the band has been put into place in this way, the pegs 41 are engaged in the aligned orifices 56 and 17 formed respectively in the annular downstream radial flange 54 and in the downstream tabs 16. Each tab 14 or 17 of the ring sector may include one or more orifices for passing a blocking peg.

The invention claimed is:

1. A turbine ring assembly comprising a plurality of ring sectors of ceramic matrix composite material forming a turbine ring and a ring support structure secured to a turbine casing and having two annular flanges;

each ring sector having a portion forming an annular base including an inner face defining an inside face of said turbine ring and said annular base including an outer face from which two tabs extend radially, said two tabs of each ring sector being held between said two annular flanges of said ring support structure;

said ring support structure including an annular retention band mounted on said turbine casing, said annular retention band including an annular web forming one of the two annular flanges of said ring support structure;

the two annular flanges of said ring support structure exerting stress on the tabs of said ring sectors; and a first annular flange of the two annular flanges of said ring support structure being elastically deformable in an axial direction of said turbine ring, wherein said annular retention band has a first series of teeth distributed circumferentially on said annular retention band and said turbine casing has a second series of teeth distributed circumferentially on said turbine casing, wherein the teeth of the first series of teeth and the teeth of the second series of teeth together provide circumferential jaw coupling, wherein the teeth of the first series of teeth are in contact with the teeth of the second series of teeth in an axial direction of said turbine casing, said turbine ring further comprising a first plurality of pegs, each of said first plurality of pegs being engaged with both the first flange of the two annular flanges of said ring support structure and a tab of said ring sectors that faces said first annular flange, and a second plurality of pegs, each of the second plurality of pegs engaged with both a second flange of said annular flanges of said ring support structure and a tab of said ring sectors that faces said second flange.

2. The turbine ring assembly according to claim 1, wherein said turbine casing has an annular projection extending between a shroud of said turbine casing and said annular retention band of said ring structure.

3. The turbine ring assembly according to claim 1, wherein at least one annular flange of said two annular flanges of said ring support structure comprises a lip on a face of said ring support structure that faces the tabs of said ring sectors.

4. The turbine ring assembly according to claim 1, wherein said first annular flange has a thickness that is less than a thickness of a second annular flange of said two annular flanges of said ring support structure.

5. The turbine ring assembly according to claim 1, wherein each of the first series of teeth are located upstream of each of the second series of teeth relative to a flow stream.

6. A method of making a turbine ring assembly, the method comprising:

fabricating a plurality of ring sectors out of ceramic matrix composite material, each ring sector having a portion forming an annular base with an inner face defining the inside face of a turbine ring, and an outer face from which a plurality of first tabs and a plurality of second tabs extend radially;

fabricating a ring support structure having a first annular flange secured to a turbine casing and an annular retention band including a second annular flange, said annular retention band being for assembling with said turbine casing;

mounting each first tab of the plurality of first tabs on said first annular flange of said ring support structure;

mounting said annular retention band on said turbine casing by jaw coupling, said second annular flange being held pressed in an axial direction against each second tab, said annular retention band being mounted with axial prestress on said turbine casing, at least one annular flange of said ring support structure being elastically deformable in the axial direction of said turbine ring, and engaging each peg of a first plurality of pegs with both the first annular flange of said ring support structure and a tab of the plurality of first tabs while mounting said plurality of first tabs, and after said annular retention band has been mounted by jaw coupling, engaging each peg of a second plurality of pegs with both the second annular flange and with a tab of the plurality of second tabs.

7. The method according to claim 6, wherein said turbine casing comprises an annular projection extending between a shroud of said turbine casing and said annular retention band of aid ring structure.

8. The method according to claim 6, wherein at least one of the first or second annular flanges of said ring support structure comprises a lip on a face of the respective annular flange that faces tabs of said ring sectors.

* * * * *